United States Patent [19]

Orsinger

[11] 4,436,299

[45] Mar. 13, 1984

[54] SHEET FEEDING DEVICE

[75] Inventor: Winston A. Orsinger, Nazareth, Pa.

[73] Assignee: Bell & Howell Company, Phillipsburg, N.J.

[21] Appl. No.: 267,277

[22] Filed: May 26, 1981

[51] Int. Cl.[3] ..... B65H 3/08

[52] U.S. Cl. ..... 271/100; 271/106

[58] Field of Search ..... 271/100, 101, 102, 106

[56] References Cited

U.S. PATENT DOCUMENTS

| | | | |
|---|---|---|---|
| 1,039,541 | 9/1912 | Kast . | |
| 1,053,781 | 2/1913 | Brown . | |
| 1,186,278 | 6/1916 | Calleson . | |
| 1,886,102 | 11/1932 | Jahne . | |
| 2,138,343 | 11/1938 | Durup | 271/12 |
| 2,394,007 | 2/1946 | Paynter | 271/101 X |
| 2,554,320 | 5/1951 | Battey | 271/26 |
| 2,564,417 | 8/1951 | Baker | 271/100 |
| 2,748,971 | 6/1956 | Flynn | 216/55 |
| 2,849,232 | 8/1958 | Halahan et al. | 271/29 |
| 3,155,386 | 11/1964 | Burleigh | 271/26 |
| 3,172,655 | 3/1965 | Lenk | 271/2 |
| 3,331,602 | 7/1967 | Cox et al. | 271/11 |
| 3,371,331 | 2/1968 | Buckholz | 340/259 |
| 3,741,535 | 6/1973 | Palkovic et al. | 271/101 |
| 4,013,283 | 3/1977 | Tress et al. | 271/14 |
| 4,060,228 | 11/1977 | Tress et al. | 271/14 |

FOREIGN PATENT DOCUMENTS

| | | | |
|---|---|---|---|
| 292613 | 11/1953 | Switzerland | 271/101 |

*Primary Examiner*—Richard A. Schacher

*Attorney, Agent, or Firm*—Griffin, Branigan & Butler

[57] ABSTRACT

A bottom-type sheet feeding mechanism having a suction-type separator includes a linkage system (38,40) mounting the suction-type separator (10) to a main frame (42) for imparting an arcuate path (12') to the suction-type separator (10). The linkage system (38,40) is mounted on the convex side of the arcuate path (12'). The linkage system (38,40) includes two links (38,40) which are pivotally attached to the main frame (42) and to the suction-type separator (10). The lengths of the links (38,40), and the positions of their pivots (44,46,50,52) on the suction-type separator (10) and the main frame (42) are such as to cause arcuate movement of the suction-type separator (10) about an axis (0) positioned close to a plane of a bottom-most sheet (14) on the concave side of the arcuate path (12'). The arcuate path (12') extends about the axis (0) over an angle of approximately 23°.

17 Claims, 5 Drawing Figures

SHEET FEEDING DEVICE

BACKGROUND OF THE INVENTION

This invention relates broadly to sheet separators, and more specifically to bottom-type sheet feeders wherein a separating device, such as a suction cup, pulls one edge of a bottom-most sheet away from a main portion of a sheet stack where a sheet-pulling device grips the separated sheet and pulls it from the sheet stack. Still more particularly, this invention is particularly well suited for pull-foot sheet feeding devices of the type described in U.S. Pat. Nos. 4,013,283 and 4,060,228 of Norwood E. Tress and Winston Orsinger. In this respect, the subject matter of those patents is incorporated herein by reference for details of pull-foot sheet feeding devices with which this invention is particularly well suited.

Portions of prior-art devices related to this invention are depicted in FIGS. 1 and 2. In operation of the FIGS. 1 and 2 device, a suction cup 10 is moved upwardly along a circular arcuate path 12 until it makes contact with the lower side of a bottom-most sheet 14 in a sheet stack 16 held in a hopper 18. In this respect, the suction cup 10 is moved along the arcuate path 12 by means of levers 20 which pivot about an axis 22 located on the concave side of the arcuate path 12, approximately at the intersection of the lower side of the bottom-most sheet 14 and a normal position of the end 23 of a breaker plate 23'. As it can be seen in FIG. 2, the levers 20 operate to the sides of the hopper 18 in order to allow the pivot 22 to be at the bottom-most sheet 14 and to leave room for other mechanisms.

In any event, once the suction cup 10 contacts the bottom-most sheet 14 suction is applied through a line 24 and the suction cup 10 is then moved downwardly along the arcuate path 12 by means of the levers 20, drawing the right hand (as seen in FIG. 1) edge of the bottom-most sheet 14 with it. At this point, a separator foot 26 (which is only partially shown in FIG. 1) is moved between the bottom-most sheet 14 and the main portion of the sheet stack 16. Vacuum in the line 24 is then released, thereby disengaging the suction cup 10 from the bottom-most sheet 14 and a segmented roller (not shown) cooperates with the pull foot 26, as it is driven outwardly, to pull the bottom-most sheet 14 with it. A complete description of the segmented roller, and its cooperation with the pull foot 26, is in U.S. Pat. No. 4,060,228 to Tress and Orsinger and that material is incorporated herein by reference.

The reason it is normally desired to place the axis 22 at the bottom-most sheet 14, close to the end 23 of the breaker plate 23', is so that the levers 20 and the bottom-most sheet 14 will pivot on approximately the same axis and the sheet will, therefore, not be put in tension or compression by outward or inward movement of the levers 20.

A difficulty with the prior art described above is that a link 28 connecting the levers 20 with the suction cup 10 obstructs access to the otherwise-available portion of the lower surface of the bottom-most sheet 14. In this respect, it is often desired to place optical sensors below the bottom-most sheet 14 to read instructions as to the disposition of the various sheets from indicia which are printed on the lower sides of the bottom-most sheets 14. However, this link 28 makes this most difficult and, in effect, prevents the use of a limited amount of space on sheets for instruction indicia.

Thus, it is an object of this invention, to provide a mechanism for moving a sheet separating device for a bottom-type sheet feeding assembly which moves the separting device along an arcuate path having an axis which is approximately in the plane of a bottom-most sheet, but which does not obstruct access to large areas of the bottom-most sheet.

It is yet another object of this invention to provide a linkage system for a sheet separating device which is uncomplicated in structure, but yet is accurate and reliable in operation.

BRIEF DESCRIPTION OF THE DRAWINGS

The foregoing and other objects, features and advantages of the invention will be apparent from the following more particular description of a preferred embodiment of the invention, as illustrated in the accompanying drawings in which reference characters refer to the same parts throughout the different views. The drawings are not necessarily to scale, emphasis instead being placed upon illustrating principles of the invention in a clear manner.

DESCRIPTION OF THE PREFERRED EMBODIMENT

Figure 1:
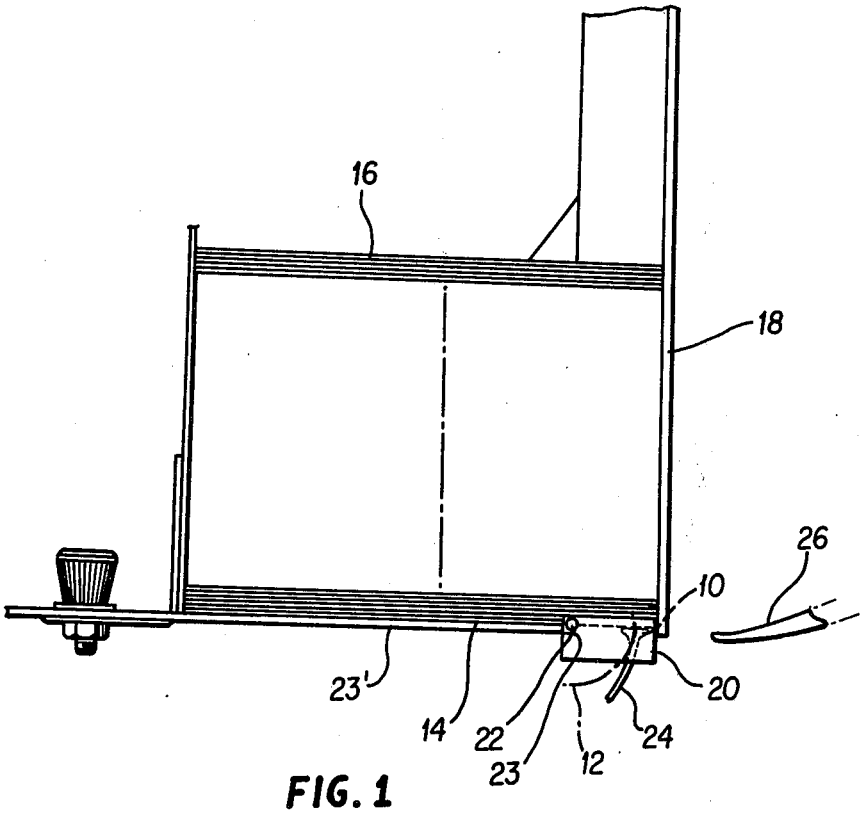
FIG. 1 (PRIOR ART)
FIG. 1 is a simplified side-sectional view, with some elements not being shown in section, of a prior-art sheet feeding mechanism related to this invention.
Figure 2:
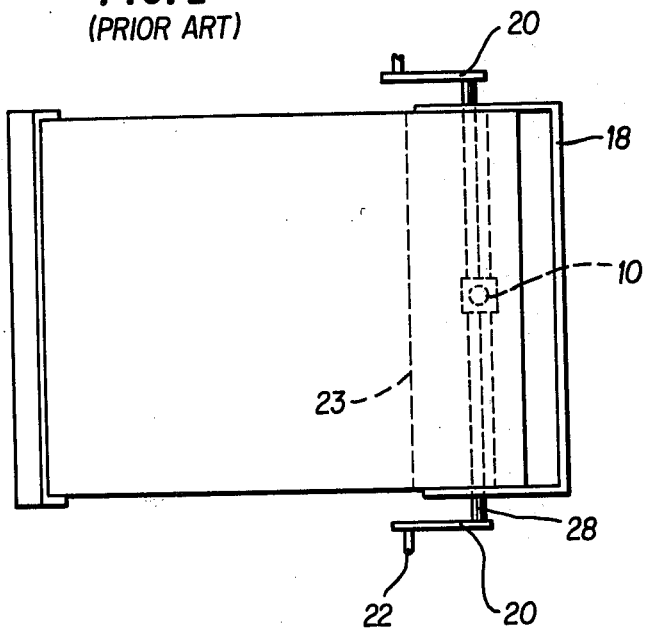
FIG. 2 (PRIOR ART)
FIG. 2 is a top view of the mechanism of FIG. 1.
Figure 3:
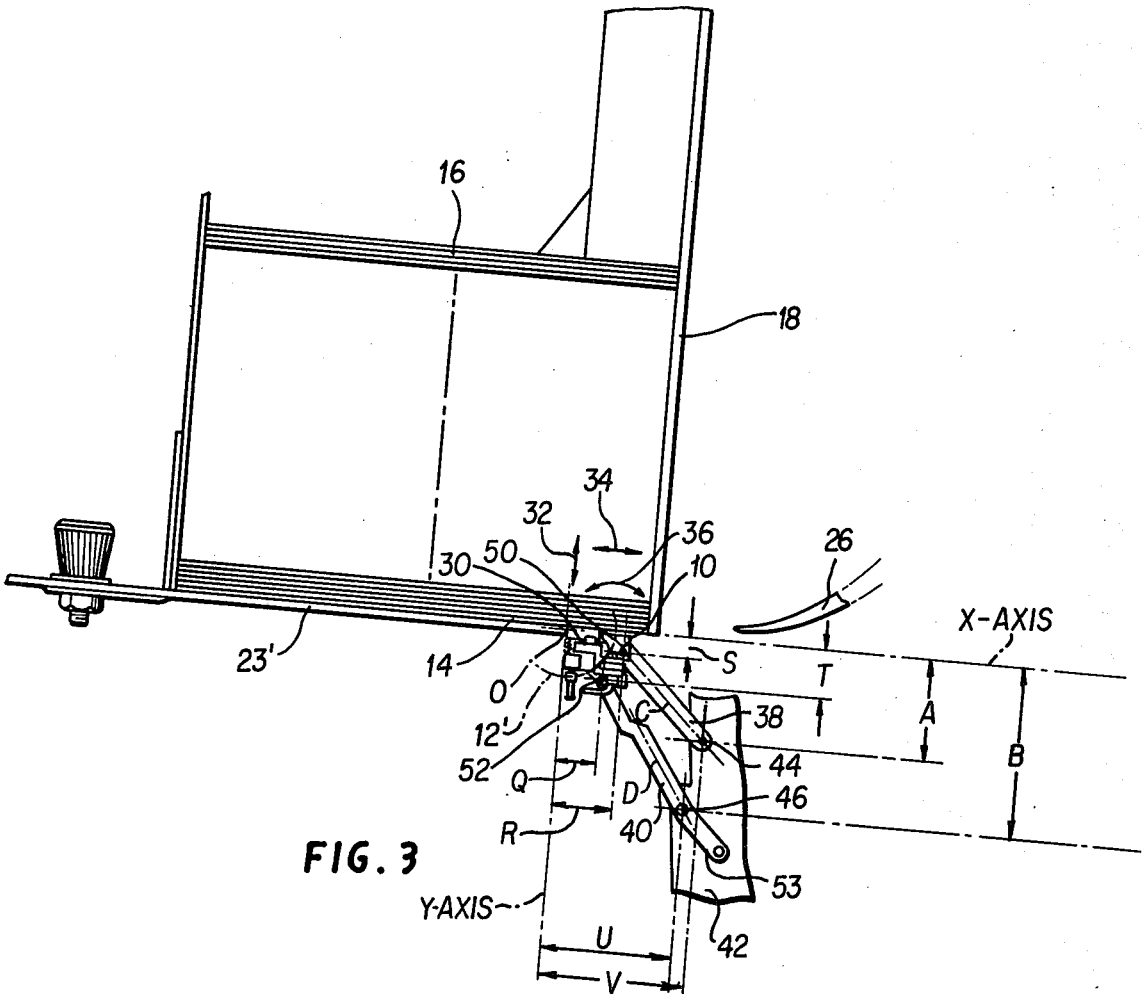
FIG. 3 is a simplified side-sectional view of a sheet feeding mechanism of this invention, which is shown partially in schematic, at a first position during its cycle of operation.
Figure 4:
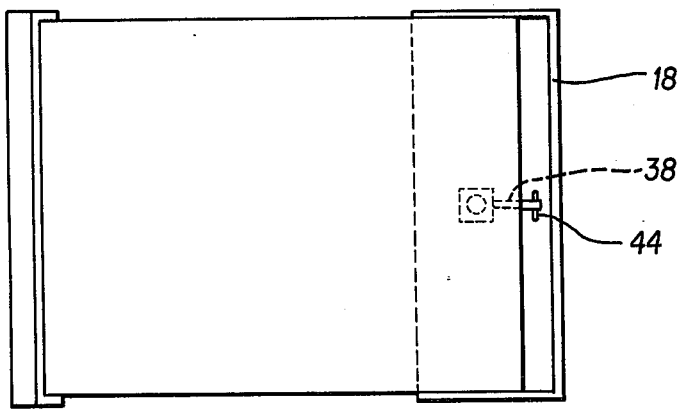
FIG. 4 is a simplified top view of the device of FIG. 3.
Figure 5:
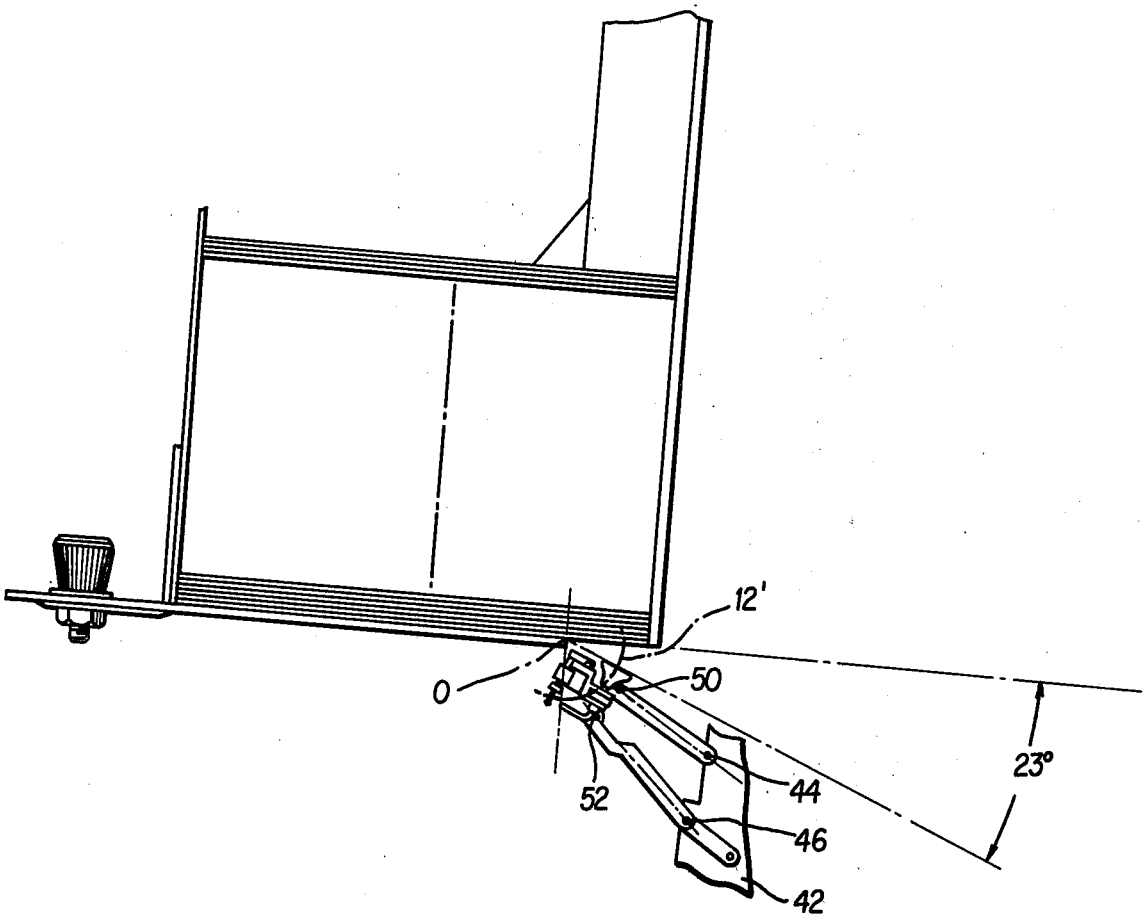
FIG. 5 is a view similar to FIG. 3, but at a second position during its cycle of operation.

Referring to FIGS. 3, 4 and 5, the sheet feeding mechanism shown therein operates overall substantially as does the mechanism of FIGS. 1 and 2, and identical elements of these two mechanisms are given the same reference numerals.

The substantial difference between the mechanism of FIGS. 3, 4 and 5 and the mechanism of FIGS. 1 and 2, insofar as this invention is concerned, is the manner in which the suction cup 10 is mounted and controlled to move along an arcuate path 12'. In this respect, the suction cup 10 is adjustably attached to a suction cup support 30. That is, the suction cup can be moved up and down, as is indicated by arrow 32 in FIG. 3, outwardly and inwardly, as is indicated by arrow 34 in FIG. 3, and in clockwise and counterclockwise pivotal directions, as is indicated by arrow 36 in FIG. 3, by the suction-cup support 30. The adjustment mechanisms of the support 30 that provide this positioning are not shown in the drawings for sake of simplicity, as it is thought that such adjusting mechanisms are old in the art. In any event, these adjustments are for "fine tuning" the position of the suction cup 10, relative to the support 30.

The movement of the suction cup 10 along the arcuate path 12' is accomplished by means of a drag link, or lever, 38 and a drive link, or lever, 40 which are respectively pivotally attached to a stationary frame 42 at offset axes 44 and 46, and, at second ends thereof, to the suction-cup support 30 at offset axes 50 and 52. It should be understood that reciprocating motion is imparted to the suction cup 10 along the substantially circular, arcuate path 12' by rotating the drive link 40 in counterclockwise and clockwise directions about its pivot 46 by a cam and spring (not shown) acting on a lever portion 53 of the drive link 40. The drag link 38 follows this motion and cooperates with the drive link 40 to control the position of the suction cup 10.

The length of the drag and drive links 38 and 40, and the positions of their pivotal axes on the stationary frame 42 and the suction-cup support 30 are carefully chosen relative to an imaginary axis 0 to provide motion of the suction cup 10 along the substantially circular, arcuate path 12' throughout an angle of 23° extending in a clockwise direction from the bottom-most sheet 14. In other words, as the suction cup 10, and its support 30, rotate downwardly, they substantially follow the same path that they would follow if they were attached to a lever pivoted at imaginary axis "0". The imaginary axis "0" is located at the forward edge of the breaker plate 23' and at the plane of the lower surface of the bottom-most sheet 14, which is the same position as axis 22 of FIG. 1. If the drag and drive links 38 and 40 were rotated so as to cause movement of the suction cup through an angle greater than 23°, its path would no longer be substantially circular about axis 0. In any event, however, the dimensions of the links 38 and 40, and the locations of their axes on a superimposed X-Y coordinate system—wherein a horizontal X axis lies in the plane of the lower surface of the bottom-most sheet 14 and a Y axis passes through the imaginary pivot axis "0",—are indicated in FIG. 3 by letters. The actual dimensions would depend upon the size of the sheets of paper being used as well as other dimensions. However, in a preferred embodiment, the following ratios and approximate dimensions produce the desired movement:

| | |
|---|---|
| A = 2.187 inch | $\frac{A}{B} = 0.511$ |
| U = 3.125 inch | $\frac{V}{U} = 1.2$ |
| C = 3.063 inch | $\frac{C}{D} = 0.846$ |
| S = .375 inch | $\frac{S}{T} = 0.353$ |
| R = 1.250 inch | $\frac{Q}{R} = 0.952$ |

where:

A and B—Y distances of axes 44 and 46 from the imaginary axis "0";

V and U—X distances of axes 44 and 46 from the imaginary axis "0";

C and D—distances between axes of the links 38 and 40;

S and T—Y distances of pivot axes 50 and 52 from the imaginary axis "0" when the suction cup 10 is against the lower surface of the bottom-most sheet 14; and, R and Q—X distances of pivot axes 52 and 50 from the imaginary axis "0" when the suction cup 10 is against the lower surface of the bottom-most sheet 14.

It will be understood by those skilled in the art that the linkage arrangement for mounting the sheet-separating suction cup 10 described herein obstructs very little of the available room on the lower surface of the bottom-most sheet 14, and therefore allows optical, and other types of sensors to be positioned at various places below the bottom-most sheet 14. A comparison of FIGS. 2 and 4 allow one to see the extent to which the available portion of the lower surface of the bottom-most sheet has been cleared for access by sensors.

While the invention has been particularly shown and described with reference to a preferred embodiment, it will be understood by those skilled in the art that various changes in form and detail may be made therein without departing from the spirit and scope of the invention.

The embodiments of the invention in which an exclusive property or privilege are claimed are defined as follows:

1. A pivoting-type of sheet separating mechanism for separating a bottom-most sheet from a main portion of a sheet stack comprising:

a main frame;

a hopper assembly mounted on said main frame for supporting a stack of sheets;

a sheet separating means for gripping a bottom-most sheet of the sheet stack and then moving along an arcuate path away from said sheet stack in a direction down and under said sheet stack, thereby bending a separated edge of said bottom-most sheet away from a main portion of said sheet stack; and a linkage means for mounting said sheet separating means to said main frame for causing said sheet separating means to move in said arcuate path in said direction down and under said sheet stack so that the apparent pivot point of said sheet separating means is on the concave side of said arcuate path, said linkage means being mounted to said main frame on the convex side of said arcuate path, however, so that the actual pivot point of said sheet separating means is on the convex side of said arcuate path.

2. A sheet separating mechanism as in claim 1 wherein said sheet separating means includes a suction cup.

3. A sheet separating mechanism as in claim 1 or claim 2 wherein said linkage means includes two links which are pivotally attached to said main frame and to said sheet separating means, with said pivotal attachments on said frame and said sheet separating means being laterally spaced from one another.

4. A sheet separating mechanism as in claim 3 wherein the length of said links and positions of their pivots on the sheet separating means and main frame are such as to cause arcuate movement about an axis positioned close to a plane of the bottom-most sheet on the concave side of the arcuate path.

5. A sheet separating mechanism as in claim 4 wherein said substantially arcuate path about said axis extends over an angle of approximately 23°.

6. A pivoting-type of sheet separating mechanism for separating a bottom-most sheet from a main portion of a sheet stack comprising:

a main frame;

a hopper assembly mounted on said main frame for supporting a stack of sheets;

a sheet separating means for gripping a bottom-most sheet of the sheet stack and, moving along a substantially arcuate path in a direction down and under said sheet stack, bending a separated edge of said bottom-most sheet away from a main portion of said sheet stack; and a linkage means for mounting said sheet separating means to said main frame for causing said sheet separating means to move in said arcuate path in said direction down and under said sheet stack so that the apparent pivot point of said sheet separating means is on the concave side of said arcuate path, said linkage means being mounted to said main frame on the convex side of said arcuate path and comprising two links each being respectively pivotally attached at said main frame and said sheet separating means, the pivotal attachments of said links on said main frame and said sheet separating means being laterally spaced from one another so that the actual pivot point of said sheet separating means is on the convex side of said arcuate path.

7. A sheet separating mechanism as in claim 6 wherein said two links are pivotally attached to said main frame on the convex side of said arcuate path.

8. A sheet separating mechanism as in claim 7 wherein one link is longer than the other so that the distance between its axes is greater than the distance between the axes of the other link.

9. A sheet separating mechanism as in claim 8 wherein the ratio of the distances between axes of the shortest link to the distances between axes of the longest link is approximately 0.846.

10. A sheet separating mechanism as in claim 7 wherein the pivotal attachment of one of said links at said main frame is closer to a plane of the bottom-most sheet than the pivotal attachment at said main frame of the other link, the ratio between these distances being approximately 0.511.

11. A sheet separating mechanism as in claim 7 wherein the distance of the pivotal attachment of one of said links to said sheet-separating means from the plane of the bottom-most sheet, when said sheet-separating means is contacting said bottom-most sheet, to the distance of the pivotal attachment of the other link to the sheet-separating means from the plane of the bottom-most sheet, when said sheet-separating means is contacting said bottom-most sheet, is approximately 0.353.

12. A sheet separating mechanism as in claim 7 wherein the pivotal attachment of one of said links to said main frame is located a longer distance from a plane normal to the plane of the bottom-most sheet, and passing through an imaginary axis of said arcuate path, than the pivotal attachment of the other link to the main frame, and the ratio between these two distances is approximately 1.2.

13. A sheet separating mechanism as in claim 7 wherein the distance of said pivotal attachments of one of said links to said sheet-separating means from a plane normal to the plane of the bottom-most sheet, and passing through an imaginary axis of the arcuate path, is shorter than the distance of the pivotal attachment of the other link to the sheet-separating means, when said sheet-separating means is contacting said bottom-most sheet, and the ratio between these two distances is approximately 0.952.

14. A sheet separating mechanism as in claim 8 wherein the pivotal attachment of said shorter link to said main frame is positioned closer to the plane of the bottom-most sheet, and further from a plane normal to the plane of the bottom-most sheet, and passing through an imaginary axis of said arcuate path, than the pivotal attachment of the longer of said links.

15. A sheet separating mechanism as in claim 14 wherein the pivotal attachment of said shorter link to said sheet-separating means is located a shorter distance from the plane of the bottom-most sheet, and a longer distance from a plane normal to the plane of the bottom-most sheet, and passing through an imaginary axis of said arcuate path, than the pivotal attachment of the longer of said links to said sheet-separating means, when said sheet-separating means is contacting said bottom-most sheet.

16. A sheet separating mechanism as in claim 8 wherein the pivotal attachment of said shorter link to said sheet-separating means is located a shorter distance from the plane of the bottom-most sheet, and a longer distance from a plane normal to the plane of the bottom-most sheet, and passing through an imaginary axis of said arcuate path, than the pivotal attachment of the longer of said links to said sheet-separating means, when said sheet-separating means is contacting said bottom-most sheet.

17. A sheet separating mechanism as in claim 8 wherein the ratios of the positions of the pivotal attachments, and the lengths of the links, with reference to the drawings are approximately as follows:

$A/B=0.511$ $V/U=1.2$ $C/D=0.846$ $S/T=0.353$ $Q/R=0.952$

* * * * *